US008590595B2

(12) United States Patent
Cretegny et al.

(10) Patent No.: US 8,590,595 B2
(45) **Date of Patent: *Nov. 26, 2013**

(54) CASTING METHODS AND APPARATUS

(75) Inventors: Laurent Cretegny, Niskayuna, NY (US); Bernard Patrick Bewlay, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/528,227

(22) Filed: Jun. 20, 2012

(65) Prior Publication Data

US 2013/0000862 A1 Jan. 3, 2013

Related U.S. Application Data

(60) Continuation-in-part of application No. 13/359,679, filed on Jan. 27, 2012, which is a division of application No. 13/075,360, filed on Mar. 30, 2011, now Pat. No. 8,151,865.

(51) Int. Cl.

| | |
|---|---|
| ***B22D 11/00*** | (2006.01) |
| ***B22D 23/00*** | (2006.01) |
| ***B22D 27/15*** | (2006.01) |
| ***B22D 18/06*** | (2006.01) |

(52) U.S. Cl.

USPC ..... 164/462; 165/423; 165/129; 165/420; 165/61; 165/257

(58) Field of Classification Search

USPC ..... 164/457, 61, 493, 523–258, 65, 66.1, 164/68.1, 136, 462, 423, 420, 129, 135, 164/253–258

See application file for complete search history.

(56) References Cited

U.S. PATENT DOCUMENTS

| | | | |
|---|---|---|---|
| 3,234,606 | A | 2/1966 | Smith, Jr. |
| 3,955,612 | A | 5/1976 | Schultheiss |
| 4,142,571 | A | 3/1979 | Narasimhan |
| 4,154,283 | A | 5/1979 | Ray et al. |
| 4,559,992 | A | 12/1985 | Bedell et al. |
| 4,592,411 | A | 6/1986 | Bedell et al. |

(Continued)

OTHER PUBLICATIONS

Gjestland et al., "Advancements in High Pressure Die Casting of Magnesium", Advanced Engineering Materials, Sep. 20, 2007, vol. 9, Issue 9, pp. 769-776.

(Continued)

*Primary Examiner* — Kevin P Kerns
*Assistant Examiner* — Steven Ha
(74) *Attorney, Agent, or Firm* — Scott J. Asmus

(57) ABSTRACT

One embodiment is a method. The method includes providing a casting apparatus including a first chamber and a second chamber, wherein the first chamber is isolated from the second chamber. The method includes charging an alloy composition into a crucible present in the first chamber and melting the alloy composition in the crucible to form a molten alloy composition. The method includes discharging the molten alloy composition into a casting mold present in the second chamber; applying a positive pressure to the first chamber to create a first chamber pressure; and applying a vacuum to the second chamber to create a second chamber pressure, wherein the first chamber pressure is greater than the second chamber pressure. The method further includes casting a filament or a turbine component from the molten alloy composition in the casting mold. An apparatus for casting a filament or a turbine component is also provided.

17 Claims, 8 Drawing Sheets

(56) References Cited

U.S. PATENT DOCUMENTS

| | | | | |
|---|---|---|---|---|
| 4,773,467 | A | 9/1988 | Graham et al. | |
| 4,982,780 | A | 1/1991 | Stepanenko et al. | |
| 5,335,711 | A | 8/1994 | Paine | |
| 5,915,450 | A * | 6/1999 | Aufderheide et al. | 164/53 |
| 6,148,899 | A | 11/2000 | Cornie et al. | |
| 6,253,828 | B1 | 7/2001 | Reiter | |
| 6,425,504 | B1 | 7/2002 | Besser et al. | |
| 6,539,620 | B1 | 4/2003 | Smashey | |
| 2006/0230984 | A1 | 10/2006 | Bredt et al. | |
| 2008/0135204 | A1 * | 6/2008 | Frasier et al. | 164/258 |
| 2009/0020253 | A1 * | 1/2009 | Knevels | 164/6 |

OTHER PUBLICATIONS

Niu et al., "Vacuum Assisted High Pressure Die Casting of Aluminium Alloys", Journal of Materials Processing Technology, Sep. 7, 2000, vol. 105, Issues 1-2, pp. 119-127.

* cited by examiner

CASTING METHODS AND APPARATUS

CROSS-REFERENCE TO RELATED APPLICATIONS

This application is a continuation-in-part of U.S. application Ser. No. 13/359,679 filed on Jan. 27, 2012, which is a divisional of U.S. application Ser. No. 13/075,360 filed on Mar. 30, 2011, the entire contents of which are hereby incorporated by reference.

BACKGROUND

The invention relates to a method and an apparatus for casting filaments or turbine components. More particularly, the invention relates to a method and an apparatus for casting filaments or turbine components using a high pressure differential furnace and mold system.

Weld wires are typically required for repair of aircraft components that have been in service for a period of time. The weld wires employed for repair of aircraft components include high performance alloys or superalloys, such as, for example, Rene 142, Rene N4, or Rene N5. These single crystal superalloy materials are directionally solidified and provide the advantages of increased strength and higher oxidation resistance in comparison to traditional alloys. However, the superalloy materials typically include a large number of alloying elements or metals, which makes these materials difficult to process into small diameter filaments employed as weld wires.

Accordingly, using conventional casting techniques and systems, superalloy ingots having a minimum diameter of ~0.2 inches are typically produced. Further, superalloy ingots cast using conventional casting techniques typically include defects, such as, shrinkage, cold shuts, or cold laps. These ingots may be then further processed using thermomechanical processing, such as, extrusion and swaging. This is followed by grinding or some other form of finishing or machining. However, the thermomechanical processing approach is expensive, the cycle times are long, and sophisticated thermomechanical processing equipment may be required.

Turbines are designed to operate in a very demanding environment which usually includes high-temperature exposure, and often includes high stress and high gas velocities. Turbine components are typically fabricated from materials such as metallic alloys, superalloys, or refractory metal intermetallic composites (RMIC's). Both superalloy and RMIC materials may be formed into useful articles, using a variety of techniques, such as, for example, forging, investment casting, or machining Gas turbine engine blades and vanes (airfoils) are usually formed by investment casting techniques. However, the typical investment casting techniques such as, gravity casting, and counter-gravity casting may be complicated and expensive, often involving multiple casting and machining steps that may lead to long casting times and the generation of defects. Further, the alloy composition used for casting the turbine components may react with the mold materials during the casting process.

Thus, there is a need to provide a method and apparatus that allows for cost-effective and on-demand production of filaments or turbine components. Further, there is a need to provide a method and apparatus for forming filaments or turbine components having defects of a size below the critical size for the maximum stresses in the application for the component.

BRIEF DESCRIPTION OF THE INVENTION

Embodiments of the present invention are provided to meet these and other needs. One embodiment is a method. The method includes providing a casting apparatus including a first chamber and a second chamber, wherein the first chamber is isolated from the second chamber. The method includes charging an alloy composition into a crucible present in the first chamber and melting the alloy composition in the crucible to form a molten alloy composition. The method includes discharging the molten alloy composition into a casting mold present in the second chamber; applying a positive pressure to the first chamber to create a first chamber pressure; and applying a vacuum to the second chamber to create a second chamber pressure, wherein the first chamber pressure is greater than the second chamber pressure. The method further includes casting a filament or a turbine component from the molten alloy composition in the casting mold.

Another embodiment is a method. The method includes providing a casting apparatus including a first chamber and a second chamber, wherein the first chamber is isolated from the second chamber. The method includes charging an alloy composition into a crucible present in the first chamber and melting the alloy composition in the crucible to form a molten alloy composition. The method includes applying a vacuum to the second chamber to create a second chamber pressure; discharging the molten alloy composition into a multifilament casting mold present in the second chamber; applying a positive pressure to the first chamber to create a first chamber pressure, wherein the first chamber pressure is greater than the second chamber pressure. The method further includes, detecting an onset of the discharge of the molten alloy composition into the casting mold, such that the positive pressure is applied to the first chamber at the onset of the discharge. The method furthermore includes casting a plurality of filaments from the molten alloy composition in the multifilament casting mold.

Yet another embodiment is an apparatus. The casting apparatus includes a first chamber including a crucible and a sealed discharge outlet. The casting apparatus further includes a second chamber including a casting mold and a discharge inlet aligned with the sealed discharge outlet of the first chamber. The casting apparatus further includes a first port for applying a positive pressure to the first chamber; and a second port for applying a vacuum to the second chamber. The casting mold includes an interior volume defined by a shape that is representative of a filament or a turbine component.

DRAWINGS

These and other features, aspects, and advantages of the present invention will become better understood when the following detailed description is read with reference to the accompanying drawings, wherein.

DETAILED DESCRIPTION

As discussed in detail below, some of the embodiments of the invention provide a method and an apparatus for casting filaments or turbine components. Some embodiments of the invention further provide a method and an apparatus for casting filaments having a small diameter (less than about 0.1 inch) and a high aspect ratio (greater than about 40). Some embodiments of the invention further provide a method and an apparatus for casting turbine components. In some embodiments, the method and apparatus allow for low-cost manufacturing of the expensive weld-wires or turbine components.

Approximating language, as used herein throughout the specification and claims, may be applied to modify any quantitative representation that could permissibly vary without resulting in a change in the basic function to which it is related. Accordingly, a value modified by a term or terms, such as "about", is not limited to the precise value specified. In some instances, the approximating language may correspond to the precision of an instrument for measuring the value.

In the following specification and the claims, the singular forms "a", "an" and "the" include plural referents unless the context clearly dictates otherwise.

As discussed in detail below, some embodiments of the invention are directed to a method for casting filaments or turbine components. The term "filament" as used herein refers to a thread or a wire having a "substantially uniform" diameter and an aspect ratio greater than about 40. The term "substantially uniform" as used herein means that a variation in the diameter of the filament is less than about 5 percent of the diameter of the filament along the length of the filament. The term "aspect ratio" as used in this context refers to the ratio of the filament length to the filament diameter. The term "turbine component" as used herein refers to a component of a wind turbine, a gas turbine, an aircraft engine, or a steam turbine. Suitable examples of a turbine component include, but are not limited to, airfoils, blades, vanes, shrouds, discs, impellers, blisks, cases, or combinations thereof.

Figure 3:
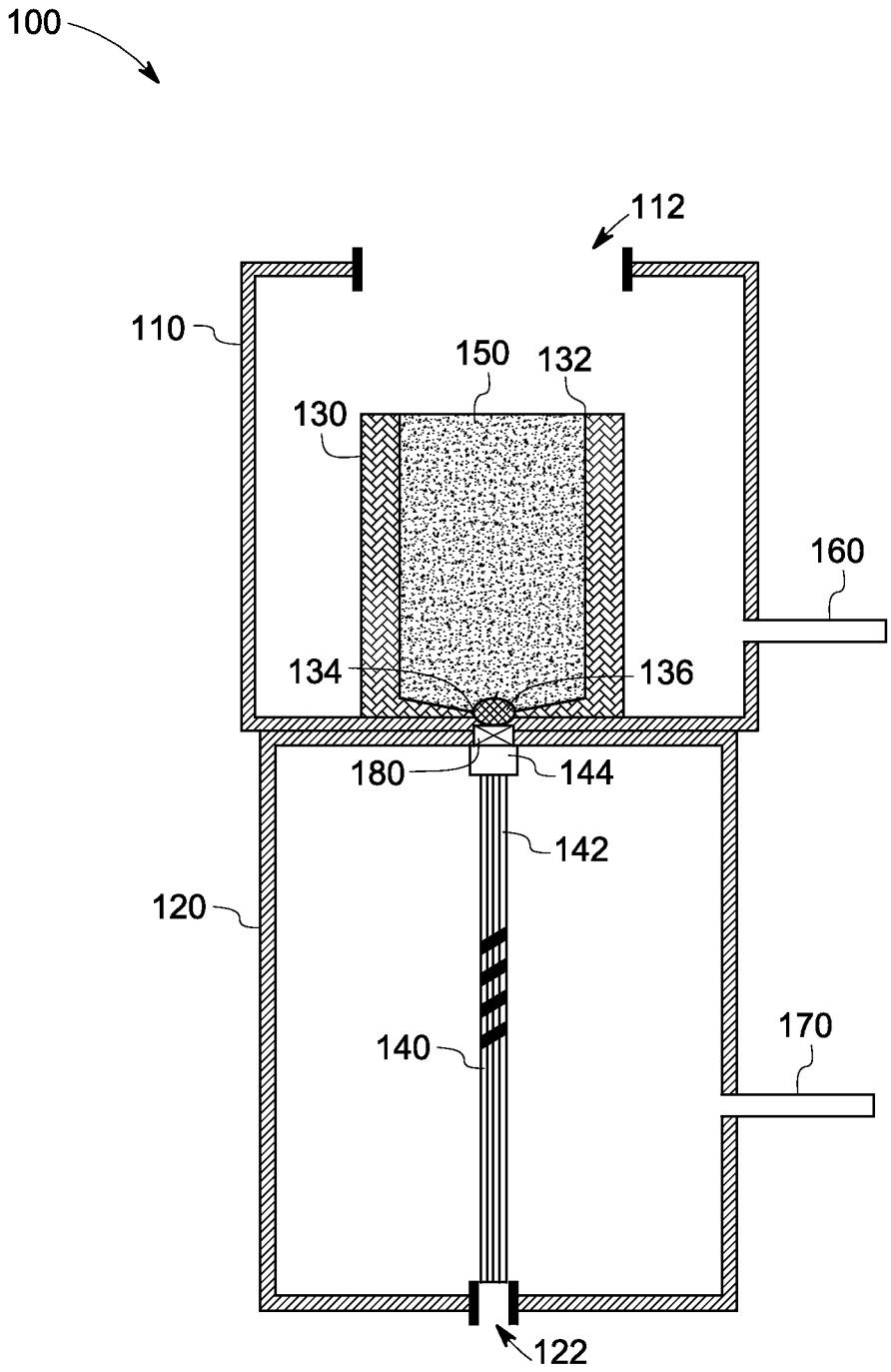
FIG. 3 is a schematic of an apparatus for casting a plurality of filaments in accordance with one embodiment of the invention.
Figure 5:
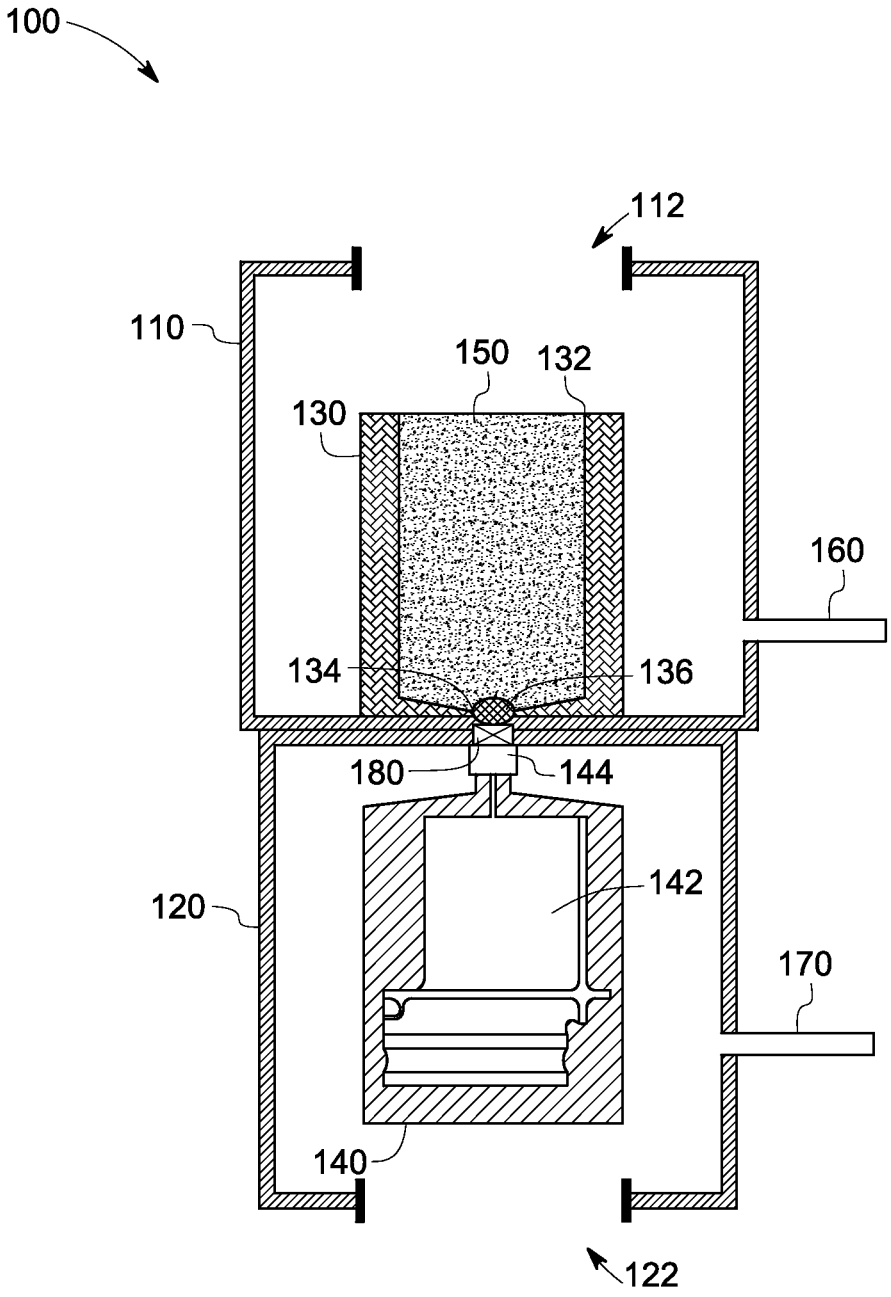
FIG. 5 is a schematic of an apparatus for casting a turbine component in accordance with one embodiment of the invention.

In one embodiment, the casting method 10 is described with reference to FIGS. 1, 3 and 5, wherein at step 12, the method includes providing a casting apparatus 100 including a first chamber 110 and a second chamber 120. As indicated in FIGS. 3 and 5, the first chamber 110 further includes a crucible 130 and the second chamber 120 includes a casting mold 140. In some embodiments, the first chamber 110 further includes a first opening 112 for loading or unloading the crucible 130 into the first chamber 110. In some embodiments, the second chamber 120 further includes a second opening 122 for loading or unloading the casting mold 140 into the second chamber 120.

In one embodiment, the first chamber 110 is isolated from the second chamber 120 during one or more steps in the casting process. In one embodiment, the first chamber 110 is isolated from the second chamber 120 with respect to flow of the alloy material, that is, there no transfer of alloy material from the first chamber 110 to the second chamber 120 during one of more of the casting process steps. In another embodiment, the first chamber 110 is isolated from the second chamber 120 with respect to pressure, that is, the first chamber may have a chamber pressure different from the chamber pressure in the second chamber. In yet another embodiment, the first chamber 110 is isolated from the second chamber 120 with respect to temperature, that is, the first chamber may have a temperature different from the chamber temperature in the second chamber. In one embodiment, the first chamber 110 and the second chamber 120 are isolated from each other at step 12 with respect to the flow of alloy material, pressure, and temperature. In one embodiment, the first chamber 110 and the second chamber 120 may be isolated from each other using a gate, a valve, or combinations thereof, as indicated by 180 in FIGS. 3 and 5

Figure 1:
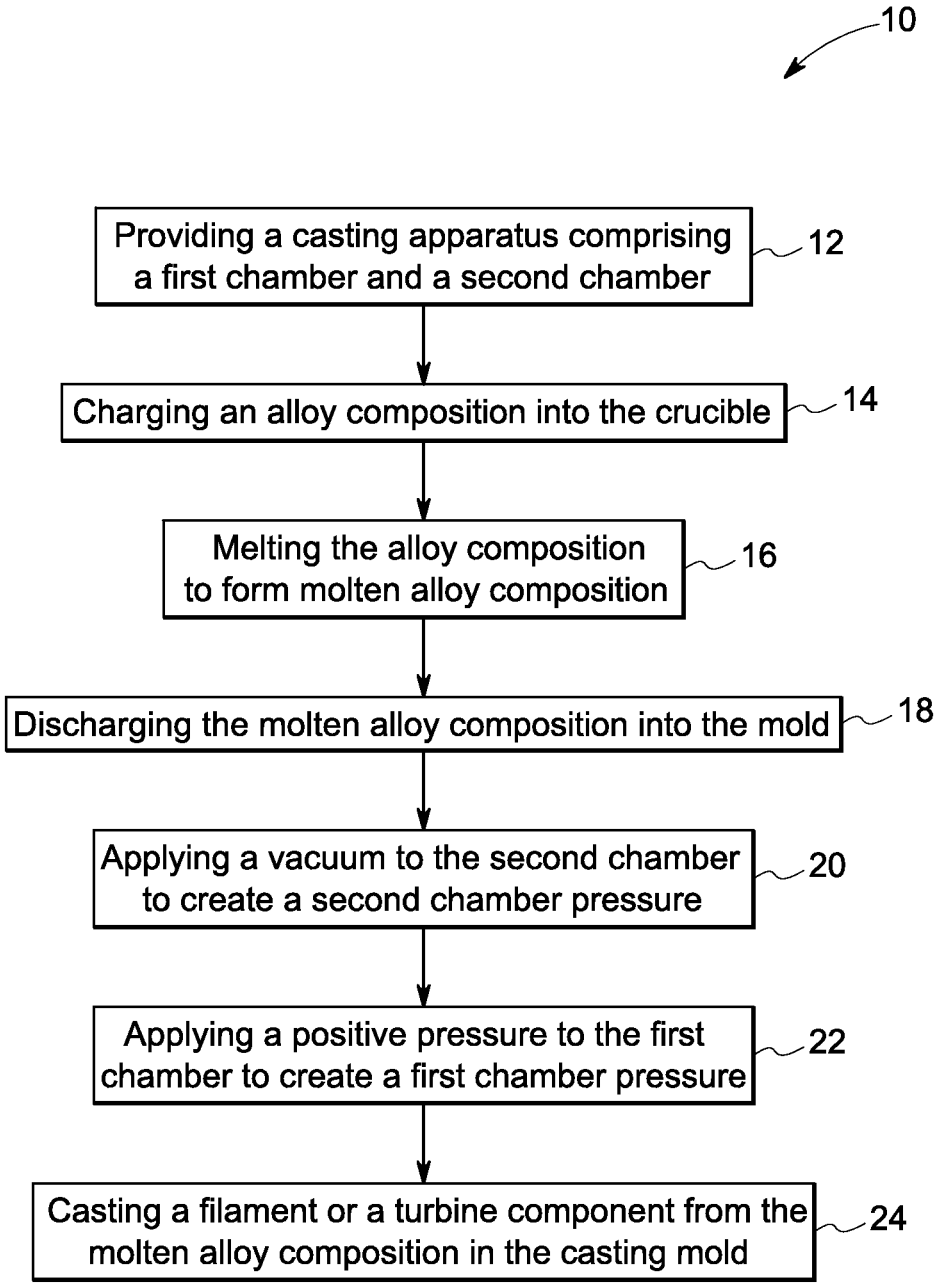
FIG. 1 illustrates a flow diagram of a method of casting a filament or a turbine component in accordance with one embodiment of the invention.

As indicated in FIGS. 1, 3 and 5, the method further includes, at step 14, charging an alloy composition into an interior volume 132 of the crucible 130 present in the first chamber 110. In some embodiments, the alloy composition may be charged into the interior volume 132 via the first opening 112 in the first chamber.

The term "alloy" as used herein refers to a combination of two or more elements. In some embodiments, the alloy includes a reactive alloy composition. The term "reactive alloy" as used herein refers to an alloy including one or more elements such as hafnium, zirconium, niobium, and titanium, because they interact in a negative manner with the conventional casting molds. In some embodiments, the alloy composition includes steel, nickel-based alloy, cobalt-based alloy, zirconium-based alloy, hafnium-based alloy, niobium-based alloy, titanium-based alloy, molybdenum-based alloy, titanium aluminide-based alloy, or combinations thereof.

In some embodiments, the alloy composition includes a superalloy composition. The term "superalloy" (also referred to as "high-performance alloy") as used herein refers to an alloy that exhibits improved mechanical strength, creep resistance, surface stability, corrosion resistance, fatigue resistance, and oxidation resistance at high temperatures. In one embodiment, the superalloy composition includes one or more of a base alloying metal, such as, for example nickel, iron, cobalt, or nickel-iron. The superalloy composition further includes one or more additional metals, metalloids, or non-metals. Non limiting example of suitable metals, metalloids, or non-metals include chromium, cobalt, molybdenum, tungsten, tantalum, aluminum, titanium, zirconium, niobium, rhenium, carbon, boron, vanadium, hafnium, yttrium, rhenium, and combinations thereof.

In one embodiment, the superalloy composition includes a material suitable for a turbine component or for use as weld-wires for repair of turbine components. In some embodiments, the superalloy composition is nickel-based. In one embodiment, the nickel-based superalloy composition further includes one or more of carbon, hafnium, tantalum, cobalt, chromium, molybdenum, tungsten, aluminum, rhenium, boron, zirconium, or titanium. In some embodiments, the superalloy composition includes Rene superalloys commercially available from General Electric, such as, for example, Rene 41, Rene 80, Rene 95, Rene 104, Rene 142, Rene N4, and Rene N5.

In one embodiment, the alloy composition to be charged into the crucible 130 is in the form of a rod or an ingot. In one embodiment, the alloy composition to be charged into the crucible 130 is in the form of an ingot having a diameter in a range greater than about 1 inch. In one embodiment, the ingot is placed directly into the crucible 130. In an alternate embodiment, the ingot is subjected to one or more processing steps, such as, partial melting before charging the alloy composition into the crucible 130. As noted earlier, the first chamber 110 and the second chamber 120 are isolated from each other during the charging step 14. In one embodiment, the first chamber 110 and the second chamber 120 may be isolated from each other using a gate, a valve, or combinations thereof, as indicated by 180 in FIGS. 3 and 5.

In one embodiment, the method further includes, at step 16, melting the alloy composition in the crucible 130 to form a molten alloy composition 150, as indicated in FIGS. 1, 3 and 5. In one embodiment, the first chamber 110 further includes an induction heating system (not shown) and the step 16 of melting the alloy composition in the crucible 130 includes heating the alloy composition using the induction heating system. In one embodiment, the induction heating system may include induction heating coils employed to heat the crucible 130 and the alloy composition. In one embodiment, the induction heating system may allow for partial levitation of the molten alloy composition 150 away from the walls of the crucible 130 and the hermetic seal 136 at the base of the crucible 130. In one embodiment, the induction heating system may allow for rapid and efficient heating and melting of the alloy composition without contamination from the crucible material. As noted earlier, the first chamber 110 and the second chamber 120 are isolated from each other during the melting step 16. In one embodiment, the first chamber 110 and the second chamber 120 may be isolated from each other using a gate, a valve, or combinations thereof, as indicated by 180 in FIGS. 3 and 5.

In one embodiment, melting the alloy composition in the crucible 130 includes heating the alloy composition at a temperature in a range from about 800° C. to about 1600° C. In another embodiment, melting the alloy composition in the crucible 130 includes heating the alloy composition at a temperature in a range from about 1200° C. to about 1500° C. In yet another embodiment, melting the alloy composition in the crucible 130 includes heating the alloy composition at a temperature in a range from about 1300° C. to about 1550° C. In some embodiments, the alloy composition includes an alloy having a high melting temperature when compared to conventional casting metals, for example, gold, silver, or platinum. Accordingly, in some embodiments, the method and apparatus of the present invention allow for high temperature melting of alloys and casting into filaments or turbine components.

In one embodiment, the crucible 130 includes a material capable of withstanding the melting temperature of the alloy composition. Further, in one embodiment, the crucible 130 includes a material that is sufficiently non-reactive with the alloy composition. In one embodiment, the crucible 130 includes a refractory material. Refractory materials include non-metallic materials having chemical and physical properties applicable for structures, or as components of systems, that are exposed to environments above at least 1000° C. In one embodiment, the crucible 130 includes graphite, alumina, rare earth metals, or combinations thereof. In some embodiments, an alumina based crucible 130 is used for melting the alloy composition.

As indicated in FIGS. 3 and 5, the first chamber 110 and the crucible 130 further include a sealed discharge outlet 134. In one embodiment, the sealed discharge outlet 134 is aligned with a discharge inlet 144 present in the second chamber 120, as shown in FIGS. 3 and 5. The sealed discharge outlet 134 prevents the flow of alloy composition from the first chamber 110 to the second chamber 120 during the melting step and after the alloy composition has completely melted.

In one embodiment, the sealed discharge outlet 134 is sealed using a hermetic seal 136. In one embodiment, the hermetic seal 136 is in the form of a plug, a button, or a penny. In one embodiment, the hermetic seal 136 allows for controlled discharge of molten alloy composition 150 from the crucible 130 to the casting mold 140. In one embodiment, the hermetic seal includes a material having a melting temperature equal to or greater than a melting temperature of the alloy composition. Accordingly, the hermetic seal 136 is the last element of the charge to melt and makes the final seal between the first chamber 110 and the second chamber 120 prior to pouring the molten alloy composition 150 into the casting mold 140.

In one embodiment, the hermetic seal 136 includes a material having a melting temperature greater than that of the alloy composition. In an alternate embodiment, the hermetic seal 136 includes a material having a melting temperature similar to the melting temperature of the alloy composition. In one embodiment, the hermetic seal includes a material having a melting temperature in a range from about 1300° C. to about 1600° C. In a particular embodiment, the hermetic seal 136 includes a material having the same composition as the alloy composition.

Figure 4:
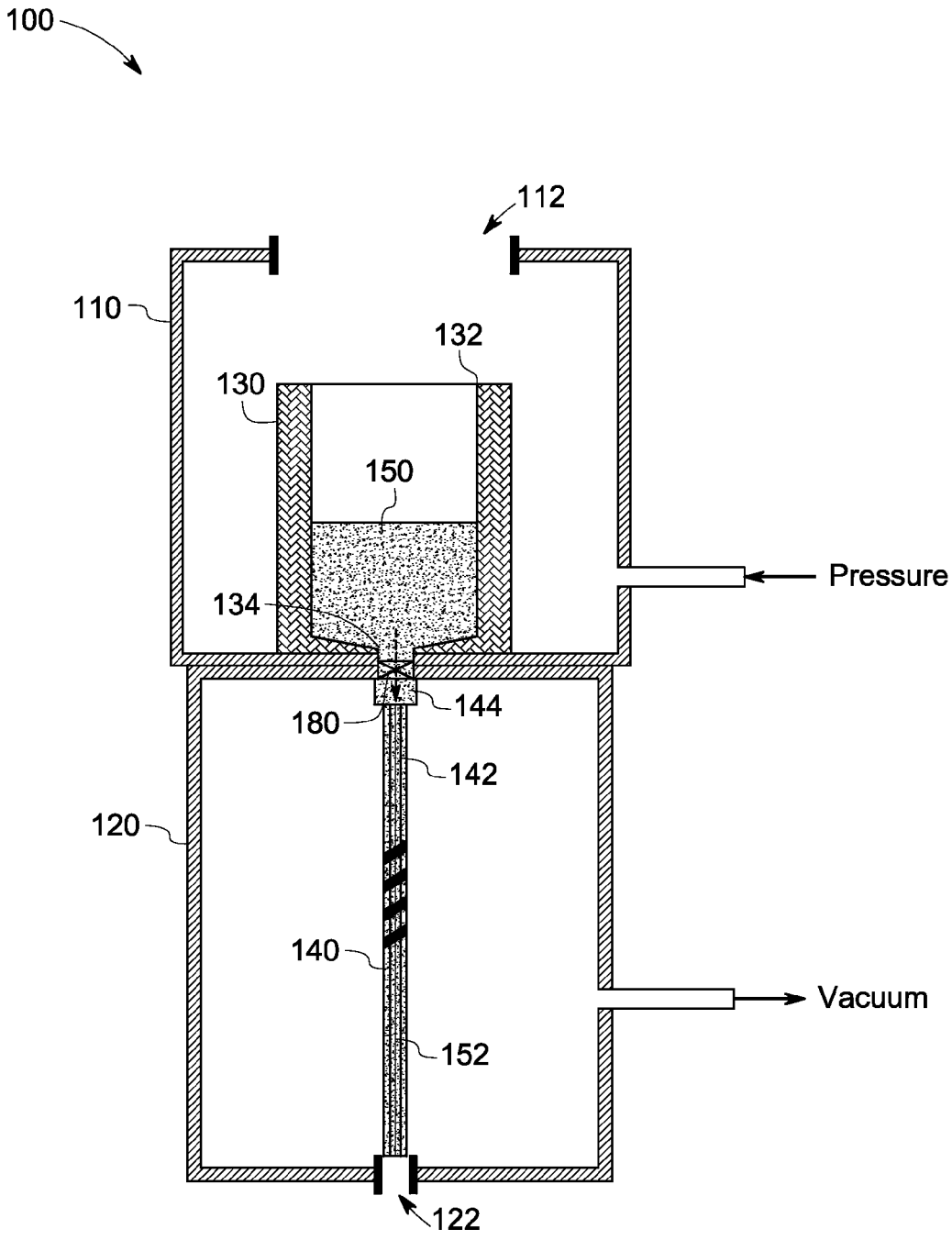
FIG. 4 is a schematic of an apparatus for casting a plurality of filaments in accordance with one embodiment of the invention.
Figure 6:
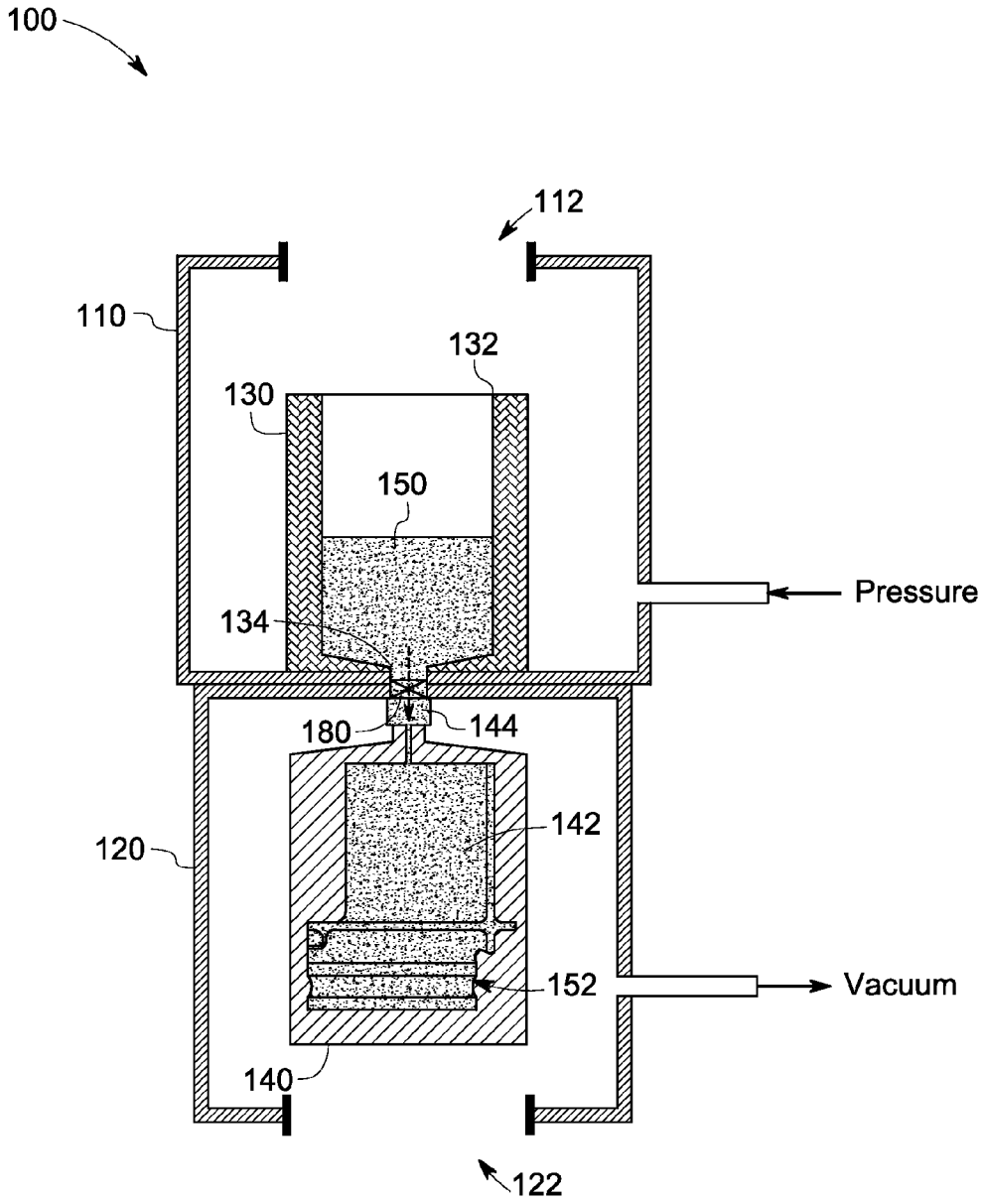
FIG. 6 is a schematic of an apparatus for casting a turbine component in accordance with one embodiment of the invention.

In one embodiment, the method further includes, at step 18, discharging the molten alloy composition 150 into an interior volume 142 of the casting mold 140 present in the second chamber 120, as indicated in FIGS. 1, 4 and 6. As noted earlier, the first chamber 110 and the second chamber 120 are isolated from each other during the charging step 14 and the melting step 16. In one embodiment, the gate or valve 180 isolating the first chamber 110 from the second chamber 120 is opened prior to discharging the molten alloy composition 150 into the casting mold 140. As indicated by the arrow in FIGS. 4 and 6, once the gate or valve 180 is opened the first chamber and the second chamber are in fluid communication with each other.

As indicated earlier, the crucible 130 includes a hermetic seal 136 that functions as the final seal between the crucible 130 and the casting mold 140. Accordingly, in some embodiments, once the hermetic seal is melted and broken, the molten alloy composition 150 is discharged into the casting mold 140. The molten alloy composition 150 that is discharged into the casting mold 140 accordingly further includes the molten hermetic seal 136 composition, in one embodiment. FIGS. 4 and 6 illustrate a casting apparatus 100, wherein a portion of the molten alloy composition 150 from the crucible 130 is discharged into the interior volume 142 of the casting mold 140. Accordingly, in one embodiment, the casting mold 140 includes a casting composition 152, wherein the casting composition includes the molten alloy composition 150 and the molten hermetic seal material 136.

Figure 7:
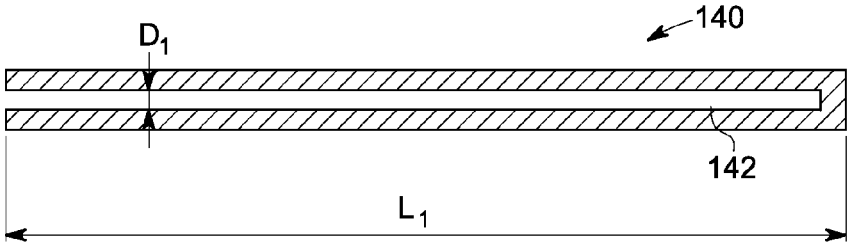
FIG. 7 is a schematic of an enlarged side-view of a filament casting mold in accordance with one embodiment of the invention.
Figure 8:
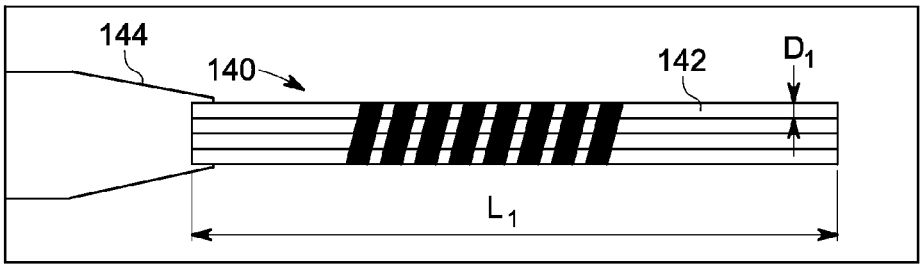
FIG. 8 is a schematic of an enlarged side-view of a multifilament casting mold in accordance with one embodiment of the invention.

In some embodiments, the casting mold 140, includes an interior volume 142 defined by a shape that is representative of a filament or a turbine component. In some embodiments, as indicated in FIGS. 7 and 8, the casting mold 140 is characterized by an interior volume 142 define by a shape that is representative of a filament, and may be referred to as a "filament casting mold". FIG. 7 shows an enlarged side-view of a filament casting mold 140 having an interior volume 142 define by a shape that is representative of a filament. FIG. 8 shows an enlarged side-view of a multi-filament casting mold 140. The term "multi-filament casting mold" as used herein refers to a mold including a plurality of filament casting molds, wherein each of the filament cavities within the casting mold has an interior volume 142 defined by a shape that is representative of a filament, as indicated in FIGS. 7 and 8. The plurality of filament cavities within the casting molds are collectively indicated by reference numeral 140 in FIG. 8.

As noted earlier, the term filament refers to a thread or a wire having a substantially uniform diameter and an aspect ratio greater than about 40. In some embodiments, the interior volume 142 of the filament casting mold 140 is characterized by an aspect ratio greater than about 40. The term "aspect ratio" as used in this context refers to a ratio of the length $L_1$ of the filament casting mold to an inner diameter $D_1$ of the casting mold 140, as indicated in FIGS. 7 and 8. In some embodiments, the interior volume 142 of the filament casting mold 140 has an average inner diameter $D_1$ that is less than about 0.1 inches.

Figure 9:
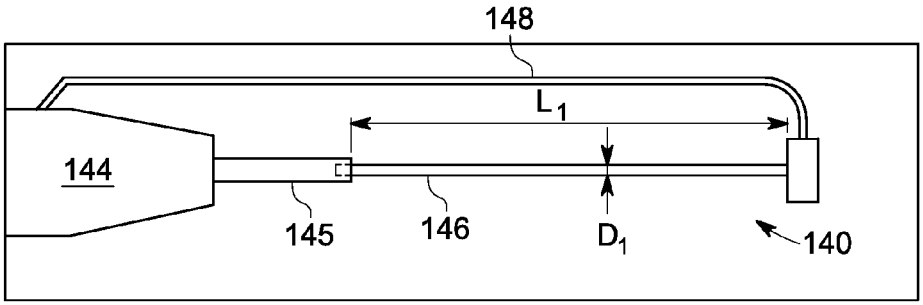
FIG. 9 is a schematic of an enlarged side-view of a stepped casting mold in accordance with one embodiment of the invention.

In some embodiments, a stepped casting mold 140, as illustrated in FIG. 9, may be used for casting a filament. FIG. 9 shows an enlarged side-view of a stepped filament casting mold 140 including at least two stages: a first stage 145 and a second stage 146, wherein the second stage functions as a filament casting mold. In some embodiments, the stepped casting mold may provide for mechanical support to the filament casting mold 146 during the casting process. Additional support may be further provided by a wax component 148, as indicated in FIG. 9. As further indicated in FIG. 9, the second region 146 includes an inner volume defined by a shape that is representative of a filament. In one embodiment, an inner volume 142 of the second region 146 is characterized by a length $L_1$ and an inner diameter $D_1$, such that a ratio $L_1$ to $D_1$ is greater than about 40.

In some embodiments, the casting mold 140, includes an interior volume 142 defined by a shape that is representative of a turbine component. In some embodiments, the interior volume 142 of the casting mold may be defined by a shape that is representative of turbine components, such as, for example, airfoils, blades, vanes, shrouds, discs, impellers, blisks, cases, or combinations thereof. In some embodiments, the casting mold 140 includes an interior volume 142 defined by a shape that is representative of a turbine component, and wherein the interior volume has an aspect ratio in a range greater than about 8. The term "aspect ratio" as used in this context refers to a ratio of the longest dimension of the turbine component to the narrowest dimension. Thus, in an exemplary embodiment, and referring to FIG. 10, an airfoil section 212 of a gas turbine blade 200 may be characterized by the length L1 of the airfoil and the thickness D1 of the airfoil, and the aspect ratio is a ratio of L1 to D1. In some embodiments, the casting mold 140 includes an interior volume 142 defined by a shape that is representative of a turbine component, and wherein the interior volume has an aspect ratio in a range greater than about 12. In some embodiments, the casting mold 140 includes an interior volume 142 defined by a shape that is representative of a turbine component, and wherein the interior volume has an aspect ratio in a range greater than about 20.

Figure 10:
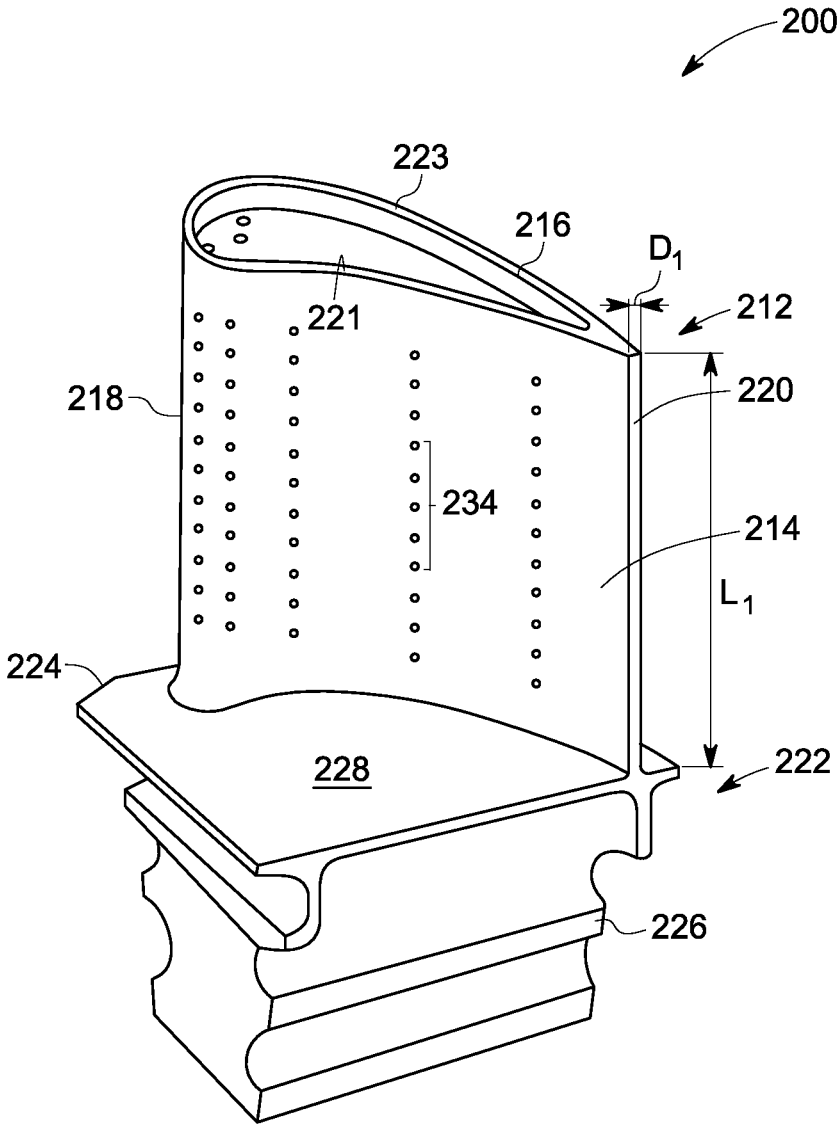
FIG. 10 is a perspective of a gas turbine engine rotor blade casting component in accordance with one embodiment of the invention.

FIGS. 5 and 6 illustrate an exemplary embodiment wherein the casting mold 140, includes an interior volume 142 defined by a shape that is representative of a gas turbine engine blade. FIG. 10 illustrates a perspective view of an exemplary gas turbine engine blade 200 to be cast in the casting mold 140. As indicated in FIG. 10, blade 200 includes an airfoil 212, having pressure and suction sides 214, 216, and leading and trailing edges 218, 220, respectively. The sidewalls 221 and 223 of the airfoil define the pressure and suction sides 214 and 216. The sidewalls are generally opposite each other in a plane with a vertical dimension of the airfoil. The lower part of the airfoil in FIG. 10 terminates with a base 222. Base 222 includes a platform 224, on which the airfoil can be rigidly mounted in upright position, i.e., substantially vertical to the top surface 226 of the platform. The base further includes a dovetail root 226, which is attached to an underside of the platform. The dovetail root is designed to attach blade 200 to the rotor. The blade 200 may further include a plurality of holes and apertures 234 that permit passage and exit of cooling air from the interior of the blade airfoil 212, as indicated in FIG. 10.

As will be appreciated by one of ordinary skill in the art, obtaining the exact, specific blade shape, exemplified in FIG. 10, using conventional casting methods and apparatus may require multiple time-consuming casting and machining steps. In contrast, the method and apparatus in accordance with some embodiments of the invention advantageously provide for faster and cost-effective casting of complicated turbine component shapes.

In some embodiments, the method and apparatus of the present invention may be used to provide "near-net-shape" components, for instance, near-net-shape, reactive alloy-containing turbine blades, and the like. The term "near-net-shape components" refers to components cast to substantially the final desired dimensions of the component, and requiring little or no final treatment or machining prior to installation.

In one embodiment, the method further includes loading the casting mold 140 in the second chamber 120 prior to discharging the molten alloy composition 150 into the casting mold 140. In another embodiment, the method further includes loading the casting mold 140 in the second chamber 120 prior to charging or melting the alloy composition 150 in the crucible 130. In some embodiments, the casting mold 140 may be loaded in the second chamber 120 via a second opening 122 present in the second chamber.

In some embodiments, the casting mold 140 is pre-heated prior to loading the casting mold 140 in the second chamber 120. In some other embodiments, the casting mold 140 is heated after loading the casting mold 140 in the second chamber 120 and prior to discharging the molten alloy composition 150 into the casting mold 140. In one embodiment, the second chamber 120 further includes a casting mold heater (not shown). In one embodiment, the casting mold 140 is heated to a temperature in a range greater than about 900° C., before onset of the discharge of the molten alloy composition into the casting mold 140.

In one embodiment, the casting mold 140 includes a material selected from the group consisting of alumina, silica, mullite, calcium oxide, calcium aluminate, zirconia, rare earth metals, rare earth metal oxides, and combinations thereof. The term "rare earth metal" as used herein includes lanthanum, cerium, praseodymium, neodymium, promethium, samarium, europium, gadolinium, terbium, dysprosium, holmium, erbium, thulium, ytterbium, lutetium, yttrium and scandium.

In some embodiments, as noted earlier, the alloy composition may include a reactive alloy composition such that the elements may react with the conventional mold material such as silica, zirconium silicate (zircon), and alumina. Accordingly, in one embodiment, the casting mold 140 includes a material that is non-reactive with the molten alloy composition.

In one embodiment, the casting mold 140 includes a material that provides minimum reaction with the alloy composition during casting, and the mold provides castings with the required component properties. In some embodiments, the casting mold 140 material includes a calcium aluminate cement composition. The term "calcium aluminate cement composition" as used herein refers to a composition includes at least one phase comprising calcium oxide and aluminum oxide. In one embodiment, the calcium aluminate cement includes at least one of calcium monoaluminate ($CaAl_2O_4$), calcium dialuminate ($CaAl_4O_7$), or mayenite ($Ca_{12}Al_{14}O_{33}$). In one embodiment, the calcium aluminate cement includes at least three phases: calcium monoaluminate ($CaAl_2O_4$), calcium dialuminate ($CaAl_4O_7$), and mayenite ($Ca_{12}Al_{14}O_{33}$). In one embodiment, the volume fraction of calcium monoaluminate in the calcium aluminate cement may be in a range from about 0.05 to about 0.95; the volume fraction of calcium dialuminate in the calcium aluminate cement may be in a range from about 0.05 to about 0.80; and the volume fraction of mayenite in the calcium aluminate cement may be in a range from about 0.01 to about 0.30.

In one embodiment, the casting mold material further includes oxide particles, non-limiting examples of which include aluminum oxide particles, calcium oxide particles, silica oxide particles, or combinations thereof. In one embodiment, the oxide particles may include hollow oxide particles. In some embodiments, the casting mold includes a surface comprising a calcium aluminate cement composition and aluminum oxide particles.

In one embodiment, the hollow oxide particles may include hollow alumina (that is, aluminum oxide) particles. In one embodiment, the aluminum oxide particles have an outside dimension less than about 10000 microns. In another embodiment, the aluminum oxide comprises particles have outside dimensions in a range from about 10 microns to about 10,000 microns. In one embodiment, the aluminum oxide particles may be present in the casting mold material at a concentration in a range from about 0.5% by weight to about 80% by weight of the mold composition. In another embodiment, the aluminum oxide particles may be present in the casting mold material at a concentration in a range from about 40% by weight to about 60% by weight of the mold composition. In one embodiment, the aluminum oxide is in the form of hollow particles comprising about 99% by weight of aluminum oxide and having an outside dimension less than about 10000 microns.

In one embodiment, the casting mold material may further include calcium oxide. In one embodiment, the calcium oxide may be present in the casting mold material at a concentration in a range from about 10% by weight to about 50% by weight of the mold composition. The mold materials and the casting mold 140 may be prepared using conventional techniques known to those of ordinary skill in the art.

In some embodiments, the calcium aluminate cement-based mold contains phases that provide improved mold strength during mold making and/or increased resistance to reaction with the casting metal during the casting process. The calcium aluminate cement-based molds according to some embodiments of the invention may be capable of casting at high pressure and high temperatures, which is desirable for near-net-shape casting methods.

In one embodiment, the method further includes, at step 20, applying a vacuum to the second chamber 120 via second port 170 to create a second chamber pressure, as indicated in FIGS. 1, 4 and 6. In some embodiments, the vacuum is applied to the second chamber 120 and the mold 140 prior to the onset of discharge of molten alloy composition into the mold 140. In one embodiment, the second chamber 120 and the mold 140 may be evacuated using a vacuum pump (not shown). In one embodiment, the second chamber 120 and the mold 140 may be continuously subjected to vacuum conditions during the step of filling the mold 140, at step 18. In some other embodiments, the vacuum is applied to the second chamber 120 and the mold 140 at the onset of discharge of molten alloy composition into the mold 140.

In one embodiment, the method further includes, at step 22, applying a positive pressure to the first chamber 110 via a port 160 to create a first chamber pressure, as indicated in FIGS. 1, 4 and 6. In some embodiments, a positive pressure may be applied using a flow of inert gas, such as, for example, argon or helium. In some embodiments, the first chamber pressure is greater than the second chamber pressure thus creating a pressure differential between the first chamber 110 and the second chamber 120. In one embodiment, the pressure difference between the first chamber 110 and the second chamber 120 is greater than about 2 atm. In another embodiment, the pressure difference between the first chamber 110 and the second chamber 120 is greater than about 2.5 atm.

Without being bound by any theory, it is believed that the high pressure differential between the crucible 130 and the casting mold 140 provides very rapid filling of the casting mold 140. In some embodiments, the high pressure differential employed provides for rapid filling and solidification of turbine components, which may lead to effective casting of complicated shapes and minimization of defects. Rapid filling of the casting mold (typically less than 2 seconds) may also be desirable for casting a filament because of the high surface area to volume ratio of the filament product. The high surface area to volume ratio provides very rapid cooling and solidification of the filament, and the rapid cooling may lead to generation of defects, such as, undesirable shrinkage, cold shuts, or cold laps. Further, the high surface area to volume ratio of filaments may lead to rapid cooling and solidification of the filament, and the rapid cooling may cause the mold cavity to be plugged or frozen shut before the filament cavity may be actually filled. In one embodiment, the high pressure differential employed provides for rapid filling and solidification of filaments, which may lead to minimization of defects, and reduce the possibility of mold plugging.

Figure 2:
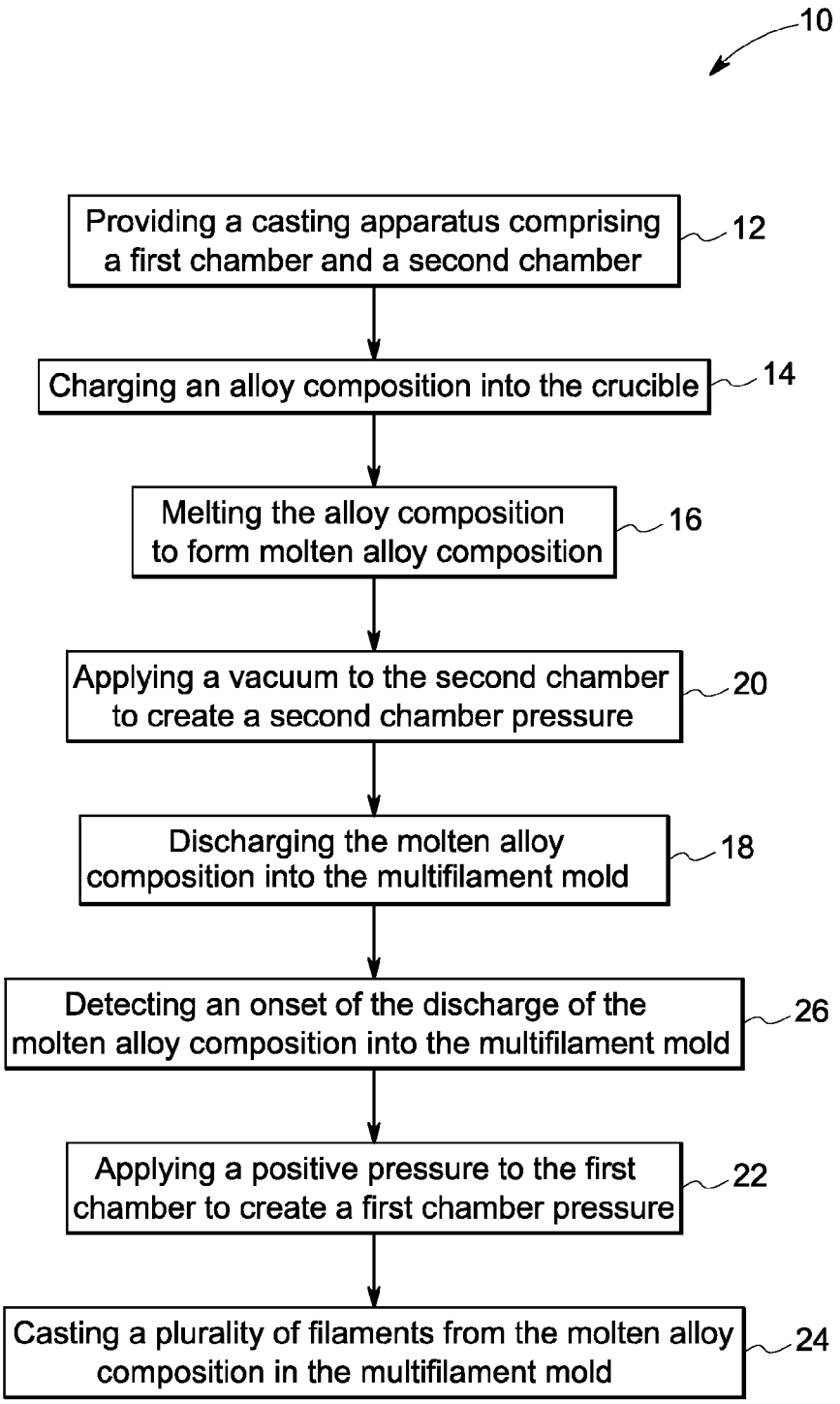
FIG. 2 illustrates a flow diagram of a method of casting a plurality of filaments in accordance with one embodiment of the invention.

In one embodiment, as indicated in FIG. 2, the method further includes, at step 26, detecting an onset of the discharge of the molten alloy composition into the casting mold 140 before applying the positive pressure to the first chamber 110, at step 22. Onset of discharge refers to the instant at which the hermetic seal 136 is completely melted and the molten alloy composition 150 starts flowing from the discharge outlet 134 present in the crucible 130. In one embodiment, the positive pressure is applied to the first chamber 110 at the onset of the discharge of the molten alloy composition 150 into the casting mold 140. In one embodiment, the onset of flow of molten alloy composition out of the crucible 130 may be detected using a photocell and further trigger the application of a positive gas pressure to the first chamber 110.

In one embodiment, the step 18 of discharging the molten alloy composition, step 20 of applying a vacuum to the second chamber, and step 22 of applying a positive pressure to the first chamber may be effected sequentially. In another embodiment, the step 18 of discharging the molten alloy composition, step 20 of applying a vacuum to the second chamber, and step 22 of applying a positive pressure to the first chamber may be effected simultaneously.

In one particular embodiment, during the discharge of molten alloy composition 150 from the crucible 130 and the filling of the casting mold 140, at step 18, the second chamber 120 is maintained under vacuum conditions and the first chamber 110 is subjected to a positive pressure to rapidly fill the casting mold 140. In one embodiment, a time duration for discharging the molten alloy composition 150 into the casting mold 140 is in a range from about 0.05 seconds to about 120 seconds. In another embodiment, a time duration for discharging the molten alloy composition 150 into the casting mold 140 is in a range from about 0.05 seconds to about 20 seconds. In a particular embodiment, a time duration for discharging the molten alloy composition 150 into the casting mold 140 is in a range from about 0.05 seconds to about 2 seconds.

Without being bound by any theory, it is believed that timing of the application of gas pressure to force the molten alloy composition into the cavity of the casting mold may affect casting process and the properties of the components formed. In one embodiment, the positive pressure is applied to alloy composition when the charge is completely molten. If the charge is not fully molten and of a controlled superheat, the casting mold may not fill completely. Alternatively, if the charge is held too long in the molten state, the molten alloy composition may react with the crucible or may be susceptible to contamination from atmospheric contaminants, which may adversely affect the properties of the components cast.

In one embodiment, the casting apparatus may further include one or more connection lines connected to a control for monitoring and detecting the onset of discharge of the molten alloy composition from the crucible 130 into the casting mold 140. On detection of the onset of discharge by the control, a positive pressure may be applied to the first chamber 110 by introducing an inert gas into the chamber to maintain the desired pressure differential between the first chamber 110 and the second chamber 120. The application of positive pressure to the first chamber may be conducted manually or in an automated manner. The pressure differential between the first chamber 110 and the second chamber 120 may be maintained until the casting mold is completely filled with the molten alloy composition, which may be further detected using a suitable detection mechanism.

In some embodiment, as indicated in FIGS. 1, 4 and 6, the method further includes, at step 24, casting a filament or a turbine component from the casting composition 152 in the casting mold 140.

In one embodiment, as indicated in FIGS. 1 and 4, the method further includes, at step 24, casting at least one filament from the casting composition 152 in the casting mold 140. As noted earlier, in one embodiment, the filament has an aspect ratio in a range greater than about 40. In another embodiment, the filament has an aspect ratio in a range greater than about 100. In another embodiment, the filament has an aspect ratio in a range greater than about 200. In yet another embodiment, the filament has an aspect ratio in a range from about 40 to about 400.

In one embodiment, the filament has an average diameter in a range less than about 0.2 inches. In a particular embodiment, the filament has an average diameter in a range less than about 0.1 inches. Accordingly, the method and apparatus of the present invention advantageously allow for casting of thin-gauge filaments of alloy materials directly from large diameter ingots (diameter greater than about 1 inch). Filaments of alloy materials of these diameters and aspect ratios may not be commercially available using conventional casting techniques In one exemplary embodiment, the casting mold 140 includes a multifilament casting mold that allows for simultaneous casting of a plurality of filaments, as indicated in an enlarged view in FIG. 8. In FIG. 8, four different filament molds are illustrated by way of example; however, in some other embodiments the multifilament mold may include more than four molds. In one embodiment, a plurality of filaments may be cast using a single hermetic seal 134 in the first chamber 110. In an alternate embodiment, a plurality of hermetic seals 134 may be used to cast a plurality of filaments in a multifilament casting mold 140, each of the plurality of seals leading to a separate filament mold. In one embodiment, the method includes, at step 24, casting at least two filaments from the casting composition 152 in the casting mold 140. In one embodiment, the method includes, at step 24, casting at least four filaments from the casting composition 152 in the casting mold 140. In one embodiment, the method includes, at step 24, casting at least ten filaments from the casting composition 152 in the casting mold 140.

In some embodiments, the cast filaments may be further subjected to post-processing steps to minimize internal defects, such as, porosity and voids. Post-processing may be conducted using a suitable technique, such as, for example, extrusion, hot isotactic processing (HIP), heat treatment, and the like. In some embodiments, the plurality of filaments cast in the casting mold 140 may be removed via the second opening 122 in the second chamber 120.

In one embodiment, the filament may be used as a weld-wire for repair of turbine components. In some embodiments, the turbine components that may be repaired using the filaments or weld-wires include one or more of a turbine blade, a vane, or a shroud. In one embodiment, an alloy ingot may be direct converted into a weld-wire having the required dimensions (diameter and aspect ratio) advantageously using the method and apparatus of the present invention on-site. Accordingly, the weld-wire may be produced to size and on-demand in the component repair and rebuild shops, rather than having to rely on a vendor and their production schedule. In some other embodiments, the weld-wires may be produced in a location remote from the repair site.

In one embodiment, as indicated in FIGS. 1 and 6, the method further includes, at step 24, casting a turbine component from the casting composition 152 in the casting mold 140. As noted earlier, in an exemplary embodiment the turbine component includes a gas turbine engine rotor blade. FIGS. 6 and 7 illustrate a method of casting a gas turbine engine rotor blade in the casting mold 140 using the method described herein. In some embodiments, the method may further include removing the cast turbine component from the second chamber 120 via the second opening 122. In some embodiments, the cast component may be further subjected to post-processing steps, such as, for example, machining steps.

In one embodiment, the method includes casting a plurality of turbine components, at step 24, from the casting composition 152 in the casting mold 140. In some embodiments, the interior volume of the casting mold 140 may be defined by a plurality of shapes that are representative of turbine components, such as, for example, airfoils, blades, vanes, shrouds, discs, impellers, blisks, cases, or combinations thereof. In some embodiments, the casting mold 140 may include a multi-cavity cluster for casting of a plurality of turbine components. In such embodiments, the method includes casting a plurality of turbine components in the casting mold that may be the same or different.

In one embodiment, a method is provided. With reference to FIGS. 2, 3 and 4, the method 10 includes providing a casting apparatus 100 including a first chamber 110 and a second chamber 120, wherein the first chamber 110 is isolated from the second chamber 120, at step 12. The method includes charging an alloy composition into a crucible 130 present in the first chamber 110, at step 14 and melting the alloy composition in the crucible 130 to form a molten alloy composition, at step 16. The method includes applying a vacuum to the second chamber 120 to create a second chamber pressure, at step 20; discharging the molten alloy composition into a multifilament casting mold 140 present in the second chamber 120, at step 18; and applying a positive pressure to the first chamber 110 to create a first chamber pressure, at step 22, wherein the first chamber pressure is greater than the second chamber pressure. The method further includes, detecting an onset of the discharge of the molten alloy composition into the casting mold, at step 26, such that the positive pressure is applied to the first chamber 110 at the onset of the discharge. The method furthermore includes casting a plurality of filaments from the molten alloy composition in the multifilament casting mold 140, at step 24.

In one embodiment, a casting apparatus is provided as indicated in FIGS. 3 and 5. The casting apparatus 100 includes a first chamber 110. The first chamber 110 includes a crucible 130 and a sealed discharge outlet 134. The casting apparatus further includes a second chamber 120. The second chamber 120 includes a casting mold 140. The second chamber 120 further includes a discharge inlet 144 aligned with the sealed discharge outlet 134 of the first chamber 110. The casting apparatus further includes a first port 160 for applying a positive pressure to the first chamber 110 and a second port 170 for applying a vacuum to the second chamber 120.

In some embodiments, the casting mold 140, includes an interior volume 142 defined by a shape that is representative of a filament or a turbine component, as indicated in FIGS. 3 and 5. As noted earlier, in some embodiments, as indicated in FIGS. 7 and 8, the casting mold 140 is characterized by an interior volume 142 define by a shape that is representative of a filament, and may be referred to as a "filament casting mold". FIG. 7 shows an enlarged side-view of a filament casting mold 140 having an interior volume 142 defined by a shape that is representative of a filament. FIG. 8 shows an enlarged side-view of a multi-filament casting mold 140. The term "multi-filament casting mold" as used herein refers to a mold including a plurality of filament casting molds, wherein each of the filament casting molds has an interior volume 142 defined by a shape that is representative of a filament, as indicated in FIGS. 7 and 8.

In some embodiments, the interior volume 142 of the filament casting mold 140 has an aspect ratio greater than about 40. The term "aspect ratio" as used in this context refers to a ratio of a length $L_1$ of the casting mold and an inner diameter $D_1$ of the casting mold 140, as indicated in FIGS. 7 and 8. In some embodiments, the interior volume 142 of the casting mold 140 has an aspect ratio in a range greater than about 100. In some embodiments, the interior volume 142 of the filament casting mold 140 has an average inner diameter $D_1$ that is less than about 0.1 inches. In some embodiments, the interior volume 142 of the casting mold 140 has an average diameter in a range less than about 0.2 inches.

In some embodiments, the casting mold 140, includes an interior volume 142 defined by a shape that is representative of a turbine component. In some embodiments, the interior volume 142 of the casting mold may be defined by a shape that is representative of turbine components, such as, for example, airfoils, blades, vanes, shrouds, discs, impellers, blisks, cases, or combinations thereof. FIGS. 5 and 6 illustrate an exemplary embodiment wherein the casting mold 140, includes an interior volume 142 defined by a shape that is representative of a gas turbine engine blade. In some embodiments, the interior volume of the casting mold 140 may be defined by a plurality of shapes that are representative of turbine components, such as, for example, airfoils, blades, vanes, shrouds, discs, impellers, blisks, cases, or combinations thereof. In some embodiments, the casting mold 140 may include a multi-cavity cluster for casting of a plurality of turbine components. In such embodiments, the turbine components defined by the plurality of shapes in the casting mold may be the same or different.

FIG. 10 illustrates a perspective view of an exemplary gas turbine engine rotor blade 200 to be cast in the casting mold 140. As noted earlier, obtaining the exact, specific blade shape, exemplified in FIG. 10, using conventional casting methods and apparatus may require multiple time-consuming casting and machining steps. In contrast, the method and apparatus in accordance with some embodiments of the invention advantageously provide for faster and cost-effective casting of complicated turbine component shapes.

In some embodiments, the sealed discharge outlet 134 includes a hermetic seal including a material having a melting temperature equal to or greater than a melting temperature of the alloy composition. In some embodiments, the sealed discharge outlet 143 includes a hermetic seal including a material having a melting temperature in a range from about 1000° C. to about 1600° C.

Further, as indicated in FIGS. 3 and 5, in some embodiments, the first chamber further includes a first opening 112 for loading or unloading the crucible 130 into the first chamber 110. In some embodiments, the second chamber further includes a second opening for loading or unloading the casting mold 140 into the second chamber 120.

In one embodiment, the first chamber 110 and the second chamber 120 are further connected to each other via a valve, a gate, or combinations thereof. As indicated in FIGS. 3 and 5, the first chamber 110 and the second chamber 120 are connected via a valve 180. As noted earlier, the valve 180 may be closed when the first chamber 110 and the second chamber 120 have to be isolated from each other, for example, during loading of the alloy composition in the crucible 130. The valve 180 may be opened when the first chamber 110 and the second chamber 120 have to be connected to each other, for example, during discharging of molten alloy composition into the mold 140, as indicated by the arrow in FIGS. 4 and 6.

The appended claims are intended to claim the invention as broadly as it has been conceived and the examples herein presented are illustrative of selected embodiments from a manifold of all possible embodiments. Accordingly, it is the Applicants' intention that the appended claims are not to be limited by the choice of examples utilized to illustrate features of the present invention. As used in the claims, the word "comprises" and its grammatical variants logically also subtend and include phrases of varying and differing extent such as for example, but not limited thereto, "consisting essentially of" and "consisting of." Where necessary, ranges have been supplied; those ranges are inclusive of all sub-ranges there between. It is to be expected that variations in these ranges will suggest themselves to a practitioner having ordinary skill in the art and where not already dedicated to the public, those variations should where possible be construed to be covered by the appended claims. It is also anticipated that advances in science and technology will make equivalents and substitutions possible that are not now contemplated by reason of the imprecision of language and these variations should also be construed where possible to be covered by the appended claims.

The invention claimed is:

1. A method, comprising:

providing a casting apparatus comprising a first chamber and a second chamber, wherein the first chamber is isolated from the second chamber;

charging an alloy composition into a crucible present in the first chamber;

melting the alloy composition in the crucible to form a molten alloy composition;

discharging the molten alloy composition into a casting mold present in the second chamber;

applying a vacuum to the second chamber to create a second chamber pressure;

applying a positive pressure to the first chamber to create a first chamber pressure, wherein the first chamber pressure is greater than the second chamber pressure; and casting a filament in the casting mold.

2. The method of claim 1, wherein the method includes casting a filament having an aspect ratio in a range greater than about 40.

3. The method of claim 1, wherein the method includes casting a filament having an average diameter in a range less than about 0.1 inches.

4. The method of claim 1, wherein the first chamber comprises a sealed discharge outlet and a second chamber comprises a discharge inlet aligned with the sealed discharge outlet of the first chamber, and wherein the sealed discharge outlet comprises a hermetic seal comprising a material having a melting temperature equal to or greater than a melting temperature of the alloy composition.

5. The method of claim 4, wherein the sealed discharge outlet comprises a hermetic seal comprising the alloy composition.

6. The method of claim 1, wherein melting the alloy composition in the crucible comprises heating the alloy at a temperature in a range from about 1000° C. to about 1600° C.

7. The method of claim 1, further comprising detecting an onset of the discharge of the molten alloy composition into the casting mold, such that the positive pressure is applied to the first chamber at the onset of the discharge of the molten alloy composition into the casting mold.

8. The method of claim 1, wherein a difference between the first pressure and the second pressure is greater than about 2 atm.

9. The method of claim 1, wherein the casting mold comprises a material selected from the group consisting of alumina, silica, mullite, calcium oxide, calcium aluminate, zirconia, rare earth metals, rare earth metal oxides, and combinations thereof.

10. The method of claim 1, wherein the alloy comprises a reactive alloy composition.

11. The method of claim 1, wherein the alloy comprises nickel-based alloy, cobalt-based alloy, zirconium-based alloy, hafnium-based alloy, niobium-based alloy, titanium-based alloy, molybdenum-based alloy, titanium aluminide-based alloy, or combinations thereof.

12. A casting apparatus, comprising:

a first chamber comprising a crucible and a sealed discharge outlet;

a second chamber comprising a casting mold, wherein the casting mold comprises an interior volume defined by a shape that is representative of a filament, wherein the interior volume has an aspect ratio in a range greater than about 40, and wherein at least a surface of the casting mold comprises a calcium aluminate cement composition, the second chamber further comprising a discharge inlet aligned with the sealed discharge outlet of the first chamber;

a first port for applying a positive pressure to the first chamber; and a second port for applying a vacuum to the second chamber.

13. The casting apparatus of claim 12, wherein the interior volume has an average diameter in a range less than about 0.1 inches.

14. The casting apparatus of claim 12, wherein the sealed discharge outlet comprises a hermetic seal comprising a material having a melting temperature in a range from about 1000° C. to about 1600° C.

15. The casting apparatus of claim 12, wherein at least a surface of the casting mold comprises a calcium aluminate cement composition and hollow alumina particles.

16. The casting apparatus of claim 12, wherein the first chamber and the second chamber are further connected to each other via a valve, a gate, or combinations thereof.

17. The casting apparatus of claim 12, wherein the first chamber further comprises a first opening for loading or unloading the crucible into the first chamber; and the second chamber further comprises a second opening for loading or unloading the casting mold into the second chamber.

* * * * *